US007914402B2

(12) United States Patent
Gaudin et al.

(10) Patent No.: US 7,914,402 B2
(45) Date of Patent: Mar. 29, 2011

(54) REBOUNDING SOCCER PRACTICE NET

(76) Inventors: Ray Gaudin, Ponte Vedra Beach, FL (US); Josh Gaudin, Ponte Vedra Beach, FL (US)

( * ) Notice: Subject to any disclaimer, the term of this patent is extended or adjusted under 35 U.S.C. 154(b) by 313 days.

(21) Appl. No.: 12/220,402

(22) Filed: Jul. 24, 2008

(65) Prior Publication Data

US 2010/0022333 A1 Jan. 28, 2010

(51) Int. Cl.
*A63B 63/00* (2006.01)

(52) U.S. Cl. ..... 473/478; 273/396

(58) Field of Classification Search ..... 473/478, 473/446, 435, 434; D32/37, 36; D23/278; D21/305; 220/9.3; 273/342, 395, 396; 114/39.18
See application file for complete search history.

(56) References Cited

U.S. PATENT DOCUMENTS

| | | | | |
|---|---|---|---|---|
| 3,376,865 | A * | 4/1968 | Gamper | 606/201 |
| 4,553,751 | A | 11/1985 | Ketchum | |
| 4,650,189 | A * | 3/1987 | Rajacich | 473/434 |
| 5,048,844 | A | 9/1991 | Haseltine | |
| 5,308,082 | A | 5/1994 | Bigelow | |
| 5,308,083 | A | 5/1994 | Grunfeld et al. | |
| 5,615,889 | A | 4/1997 | Long | |
| 5,667,066 | A * | 9/1997 | Simpson | 206/278 |
| 5,938,546 | A | 8/1999 | Caruso | |
| D420,074 | S * | 2/2000 | Whitham-Taudien | D21/705 |
| 6,149,152 | A | 11/2000 | Mancke | |
| 6,209,878 | B1 | 4/2001 | Munro | |
| 6,287,220 | B1 | 9/2001 | Caruso | |
| 6,517,444 | B1 * | 2/2003 | Yoon | 473/197 |
| 6,607,455 | B1 | 8/2003 | Petras | |
| 6,846,253 | B1 | 1/2005 | Szwalek | |
| 6,979,274 | B1 | 12/2005 | Raber | |
| 7,125,351 | B1 | 10/2006 | Raber | |
| 2008/0067751 | A1 | 3/2008 | Hunt | |

FOREIGN PATENT DOCUMENTS

| | | | |
|---|---|---|---|
| KR | 100751625 | B1 | 8/2007 |
| WO | WO 2006/025752 | A1 | 3/2006 |

* cited by examiner

*Primary Examiner* — Gene Kim
*Assistant Examiner* — Mike Chambers
(74) *Attorney, Agent, or Firm* — Leason Ellis LLP

(57) ABSTRACT

The Present invention is a portable apparatus for use in practice drills and educational settings which returns soccer balls to a kicker in a controlled manner. The invention utilizes an upwardly inclined net which directs a ball upwards into an energy absorbing pocket rather than immediately rebounding the ball back to the kicker. The pocket then absorbs the energy of the ball and then sends the ball back down to the kicker in a controlled manner. The goal of the invention is to increase the user's accuracy and to allow for increased amounts of kicks as the controlled return allows for less reset time between kicks.

15 Claims, 11 Drawing Sheets

REBOUNDING SOCCER PRACTICE NET

BACKGROUND OF THE INVENTION

This invention is concerned with a device which is used to aide persons seeking to practice and work on enhancing their soccer skills. The device is a soccer goal using an energy absorbing net which slows the velocity and rate of speed of a ball before returning it in a controlled manner to the kicker.

It is known in the prior art that soccer nets can be used in a manner in which they rebound balls to the player that is kicking the ball into the net and/or persons in the general vicinity of the net. U.S. Pat. No. 5,938,546 (the '546 Patent), to Caruso, discloses an Apparatus for Rebounding Balls. According to the '546 Patent, "[n]umerous innovations for rebound apparatus have been provided in the prior art . . . ". (See the '546 Patent, Column 1, Lines 10-11). The invention described in the '546 Patent is an apparatus for rebounding balls that is simple and inexpensive to manufacture.

The '546 Patent discloses an invention that includes "a frame and a net structure within the frame, and has an upright position, a rear down position, and a front down position so as to allow the apparatus to be used in a variety of positions." See the '546 Patent, Column 2, Lines 38-41). The preferred embodiment of the net disclosed in the '546 Patent has a frame made of tubular steel. See the '546 Patent, Column 4, Lines 12-19). The net disclosed and claimed in the '546 Patent has a front and rear section, each with netting contained within that allows for the rebounding of balls hit into the net from the opposite sides.

The current invention has several notable differences not disclosed or claimed in the '546 Patent. Most notably, there is no energy absorbing pocket or any equivalent structure or component on the top of the net disclosed in the '546 Patent. There is arguably not even a way to incorporate such a feature on this net as its frame is remarkably different from that in the present invention. The frame in the '546 Patent seems to have front and rear net sections which are connected in a U like manner at the apex of the frame. This is different from the X shaped frame of the present invention which allows sufficient space for energy absorbing pocket to be placed on the top of the net. The '546 net would not be able to contain a ball if it rolled above the net nor would the net be able to absorb the balls energy and return it in a controlled manner. It is significantly this feature of the present invention which distinguishes it from the prior art net described in the '546 Patent. The energy absorbing pocket in essence corrects a flaw in the invention disclosed and claimed in the '546 Patent as that invention does not have the ability to control the return of balls which go above the net after being directed upwards.

Additionally, U.S. Pat. No. 5,308,083 (the '083 Patent) to Grunfeld, discloses a Soccer goal with a rebounding net for returning the ball to the kicker. The net disclosed in the '083 Patent has a frame formed by a pair of vertical posts and a long horizontal tube. The horizontal tube is basically two bars that telescope into a connector which joins them together. It has hooks that secure it and a resiliently stretchable rope used to help increase net tension. The rebounding effect of the net disclosed in the '083 Patent takes place due to the increased tension in the net. The tension can be increased and decreased by adjusting the stretchable cord. Portability is another disclosed feature of the device described and claimed in the '083 Patent.

Portability is another disclosed feature of the device described and claimed in the '083 Patent. The '083 Patent claims not only a rebounding soccer goal, but a method of assembling a rebounding soccer goal as well. The method of making the net in the present invention has not been disclosed and should be compared with that in the '083 Patent, to wit, the method in claim 5. Such being the case, no representation is made herein regarding the novelty of the net of the present invention and/or its possible infringement upon the method for making the net claimed in the '083 Patent.

The net disclosed in the '083 Patent is different in a number of ways from that in the present invention. Most notably, the utilization of a net with tension in order to rebound the ball is a significant difference. The net of the present invention does not work in such a manner as to rely on net tension, but rather, it is arguable that the energy absorbing pocket does the opposite, it relies on a lack of tension to absorb the ball's energy and subsequently uses gravity in order to rebound the ball. As a result, the rebound effect is slightly more delayed and controlled. Once again it is the energy absorbing pocket that differentiates the net of the present invention from the prior art net.

The prior art nets rebound a ball in a manner such that the ball was rebounded upwardly, or straight. The prior art nets do not rebound a ball downwardly. Those nets that do rebound downwardly utilize an intricate methodology that frustrates portability. The prior art soccer goals have more emphasis on fast and uncontrolled rebounding, rather than controlled slower rebounding. This is mainly because high net tension was used as the rebound mechanism. Looser nets were not useful for prior art nets as their ability to rebound using the mechanisms these nets employed, to wit, upward and straight rebounding, as a looser net would not be able to rebound as efficiently when employing said mechanisms.

However, it has not been possible heretofore to efficiently and easily rebound a ball in a controlled manner so that the ball will more easily return to the kicker. The prior art nets teach away from the type of ball return utilized by the current invention. They rely on the premise that the energy and velocity of the ball should not be absorbed and reduced but rather, that rebounding and redirecting the energy and velocity of the ball is an important method of teaching as it increases reflex response time and ball handling instincts.

More important, it has not been possible heretofore to send a ball back to the kicker in a controlled manner without relying on "Rube Goldberg" like contraptions. U.S. Pat. No. 6,149,152 (the '152 Patent) to Mancke, discloses an apparatus for facilitating the teaching and practice of soccer related skills. The invention disclosed and claimed in the '152 Patent is a cumbersome system which does anticipate and disclose a slower ball return but uses an extensive process using elevated target boards and target apertures through which controlled ball return is accomplished. The present invention accomplishes controlled ball return in a more efficient manner and is more conducive to portability than the invention disclosed and claimed in the '152 Patent.

SUMMARY OF THE INVENTION

It has now been discovered that the use of an energy absorbing pocket which rebounds downwardly on the top of a soccer goal is an important teaching and practice tool for soccer players and for the players of games in which a ball is kicked into a net or other goal. This pocket is to be marketed using the name and trademark KicPocket and/or KyKPocket.

Prior art goals redirected the energy and velocity of the ball back to the player and rebounded the ball quickly. The present invention directs the ball up in a controlled manner into a pocket which then absorbs the energy of the ball, rather than bouncing it straight back. Once the energy is absorbed, the ball is then returned to the kicker in a controlled, slower manner than the manner in which the ball was kicked into the net.

Unlike prior art goals, which teach away from the methodology of the present invention, the present invention gives the kicker a larger time interval between kicks in which to reset himself and practice other important aspects of his or her game such as, among other things, footing and positioning. Prior art goals are more concerned with immediately rebounding a ball hit into the net. The present invention does not immediately rebound a ball hit into the net. The present invention directs a ball hit into the goal upward into an energy absorbing pocket which then absorbs the energy of the net and returns it downward in a controlled manner. This difference in ball return methodology allows soccer players of all levels to concentrate on other aspects of their game and technique in addition to kicking by allowing them more time between kicks to reset and more controlled ball return.

The present invention is portable and accomplishes the goal of absorbing the energy of a ball and redirecting it in a controlled manner back to the kicker in a far more efficient manner than other prior goals and machines which may have been able to return a ball in a controlled manner rather than immediately bouncing the ball back to the kicker. The use of an energy absorbing pocket in conjunction with a looser upwardly inclined net allows for a controlled ball return goal that is portable, lightweight and easy to use and maintain.

The net is unique in its claim that it is the only practice net that rebounds the ball to the user in a controlled manner, no matter what velocity it is kicked with. This allows undeveloped and developed players the opportunity to practice their technique with the most touches on the ball.

It is, a known fact that is promoted by coaches that players develop with more practice and touches on the ball than any other method. This practice net allows more touches per minute or hour than any other device. The reason is the unique energy absorbing pocket or "kicpocket" technology that arrests the ball at the top of the net and returns it to the player using gravity. Unlike other nets where balls must be retrieved and re-kicked or the ball returns with unharnessed velocity and erratic directions, the kicpocket returns the ball precisely back to the foot of the player allowing repeatable and more copious practice kicks.

Thus, there are several embodiments of the present invention. The present invention can be used as a total goal system or as a removable energy absorbing pocket for use in conjunction with prior art goals which utilize and/or have the ability to utilize an upwardly inclined net and/or a net which will direct a ball into the energy absorbing pocket. The energy absorbing pocket is either attached to or interconnected with a soccer goal distal from the bottom of the goal. The pocket in its detachable embodiment is a loose mesh netting which is connected to a framework allowing the mesh net to form a pocket. This framework has a means for attaching it to a prior art soccer goal, allowing a goal which is upwardly inclined to guide a ball hit towards it into the energy absorbing pocket, which then catches the ball and using gravity sends the ball back in a controlled manner. It is important the net be loose enough to form a pocket but not so loose and full of slack as to catch the ball and not have the ability to return it to the kicker.

The rebounding pocket used to catch and return balls can contain a low or high tension net. The high tension net would be used to have high velocity controlled returns and the low tension net would be used to have slower more controlled returns. In theory, there is no limit on the tension of the net on the high end. In fact, the pocket could very well be downwardly inclined, forming a V with the soccer goal net. However, as set forth herein, the tension on the low end has limitations as a net with two little tension will simply hold the ball rather than returning it if the pocket is big enough.

BRIEF DESCRIPTION OF THE DRAWINGS

FIG. 1 is an elevational view from the front of the preferred embodiment of the Practice Net with the Power Arm locked in.

DESCRIPTION OF THE PREFERRED EMBODIMENT

Figure 1:
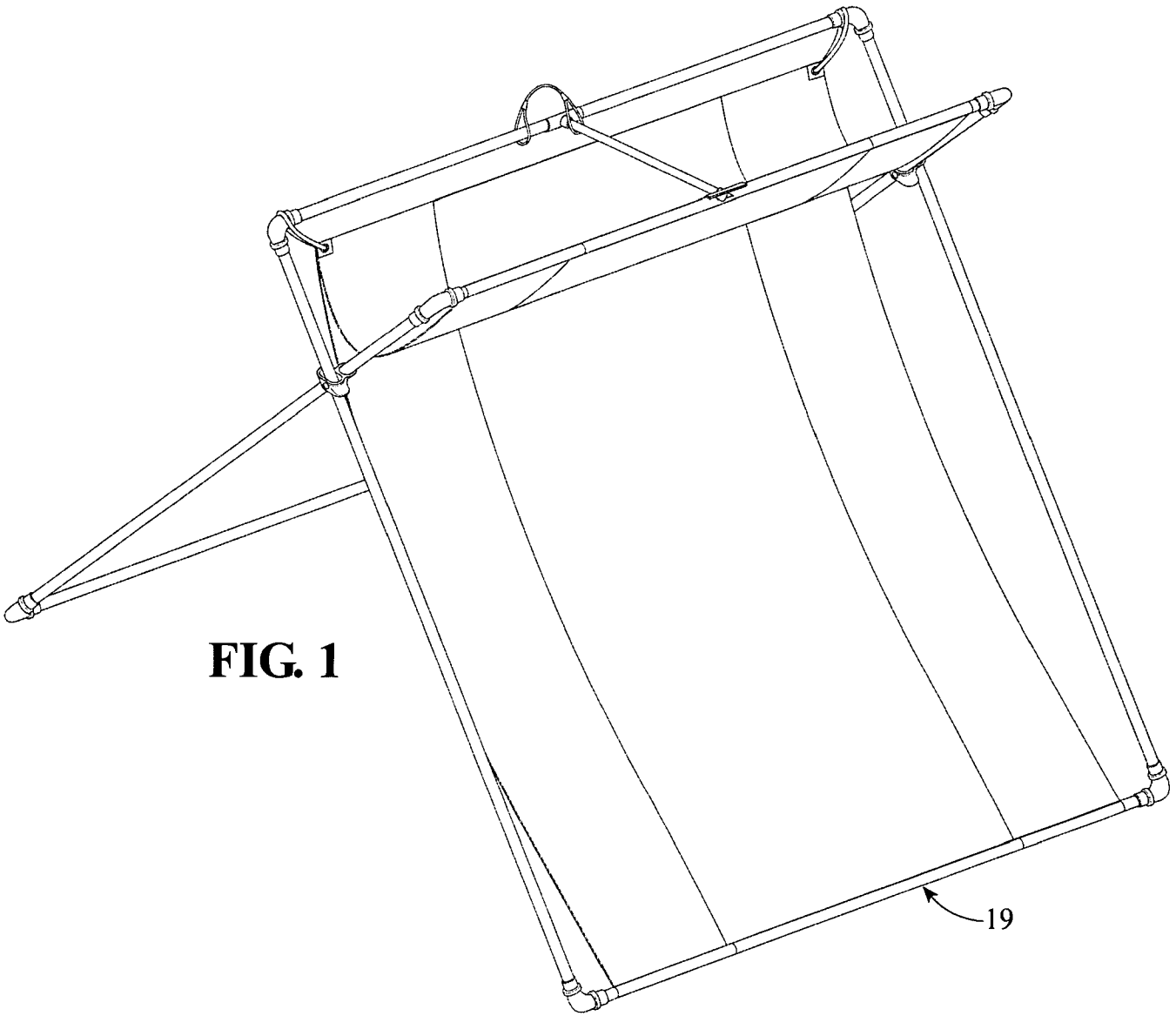

There are a number of different ways in which the invention claimed herein can be manufactured. This Description of the Preferred Embodiment shall make reference to FIGS. 1 through 6. The preferred embodiment is a soccer goal as depicted in FIG. 1 having an upwardly inclined net 1 which will direct the ball into the energy absorbing pocket 10, which will then catch the ball, slow its velocity and then use gravity to return the ball down the upwardly inclined net 1 to the kicker. The preferred embodiment for the energy absorbing pocket 10 is a goal or device that has such a pocket interconnected with it, the latter being the type of Net contemplated in the invention depicted in FIGS. 1-6.

The configuration of the invention in the preferred embodiment is an apparatus for facilitating the return of soccer balls with an X frame.

The preferred embodiment of the frame of the invention is two square or rectangle pole configurations/members connected to form an X, to wit, a front member and a back member. These squares which make up the X frame can be seen in FIG. 1, the view of the back square being partially obstructed by the upwardly inclined Fabric Tarp 1. The preferred embodiment of the upwardly inclined Fabric Tarp 1 is a net constructed of a woven acrylic polyester open canvas material that uses a high strength nylon belting material to reinforce a bottom loop 19. The front member/pole configuration is created by attaching a right front vertical pole 13 and a left front vertical pole 14 at the tops to a back Top Horizontal Pole 17 using top corner braces 2. The right front vertical pole 13 and the left front vertical pole 14 are then connected at their bottoms to a Front Bottom Horizontal pole 15 using bottom corner braces 6. Each corner brace (6 and 2) has a safety pin snap 12 which allows the pole and the corner brace to lock into place upon the proper connection of the corner brace (6 and 2) to the poles (13, 14, 15, 16, 17, 18, 20 and 21). The horizontal tubes of the framework connect with the side X assemblies by using a spring loaded safety pin snap system 12. The safety pin snap is located in a predrilled hole in the poles (13, 14, 15, 16, 17, 18, 20 and 21) and the predrilled holes in the corner brace (6 and 2). The preferred embodiment of the top corner braces 2 is a brace made of high impact plastic. The preferred embodiment of the bottom corner braces 6 is a brace made of rubber.

The back member/pole configuration is created by attaching a right back vertical pole 20 and a left back vertical pole 21 at the tops to a Front Top Horizontal Pole 18 using top corner braces 2. The right back vertical pole 20 and the left back pole 21 are then connected at their bottoms to a back Bottom Horizontal pole 16 using bottom corner braces 6. The preferred embodiment of the invention has Poles (13, 14, 15, 16, 17, 18, 20 and 21) which are tubular and made of powder coated steel.

Figure 6:
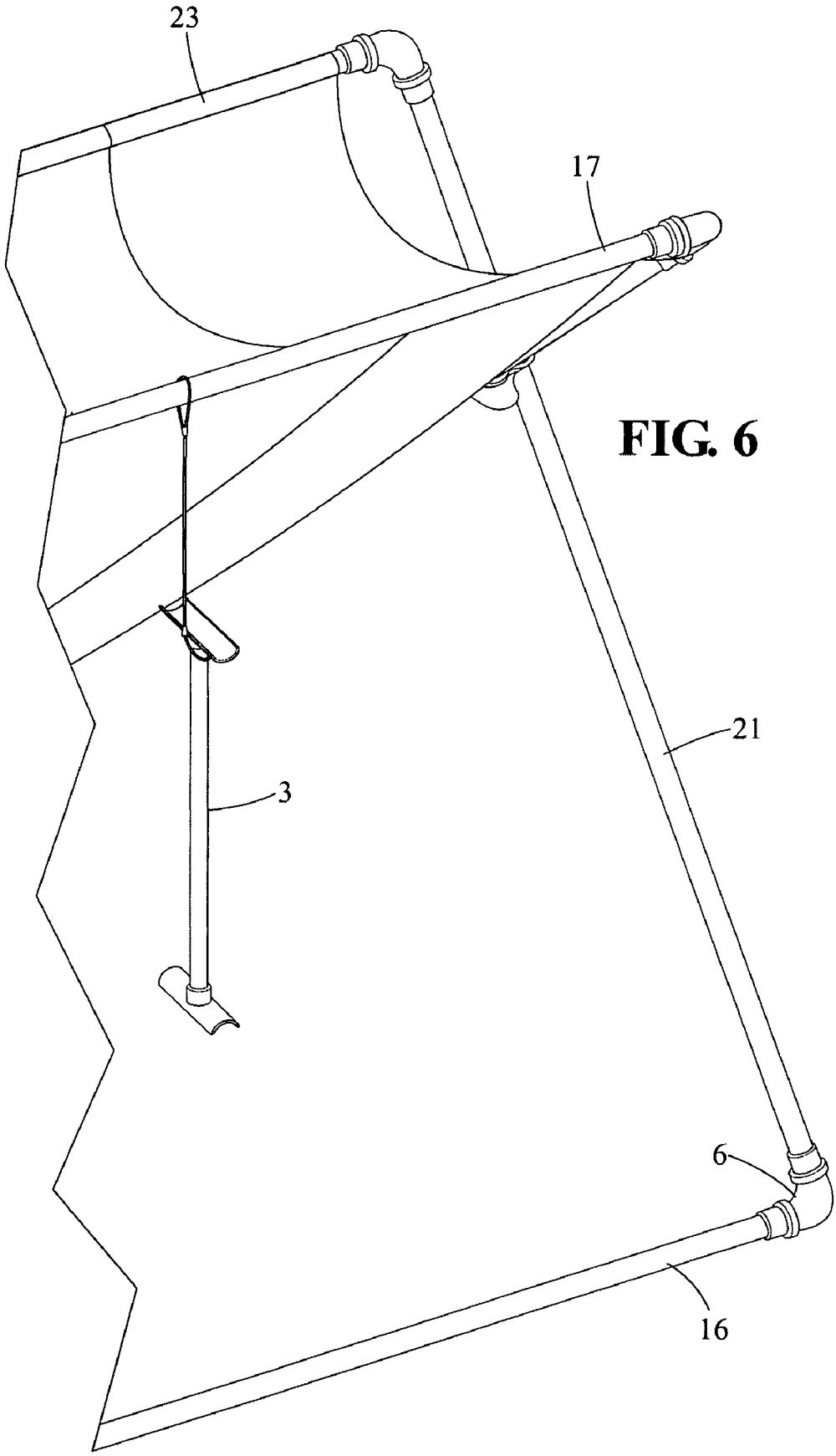
FIG. 6 is a top left back perspective view of the Practice Net of FIG. 1 also depicting the Power Arm in a disconnected state.
Figure 7:
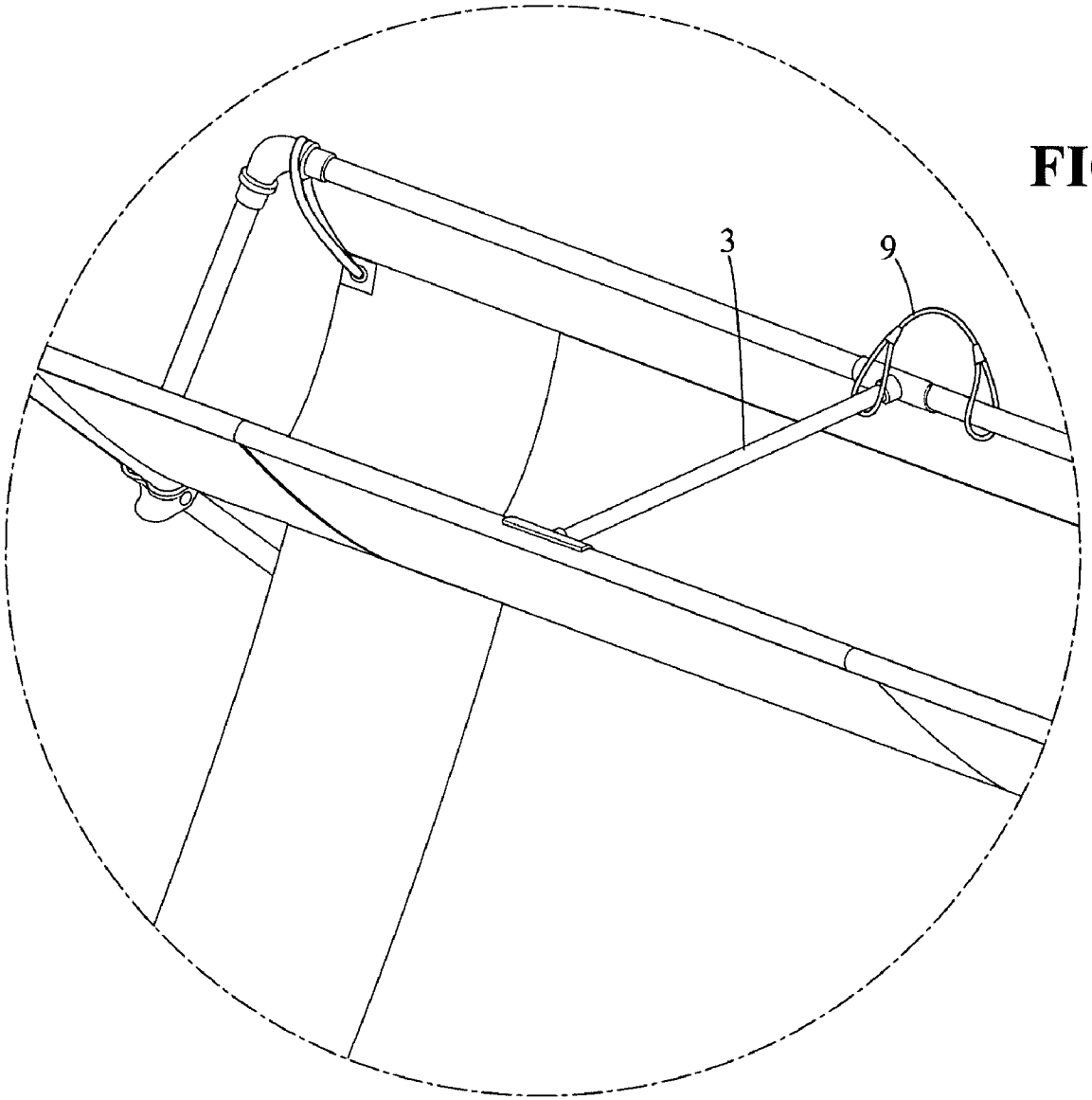
FIG. 7 is a close up view of the left top front of the Practice net of FIG. 1 also depicting the Power Arm in a connected state.
Figure 8:
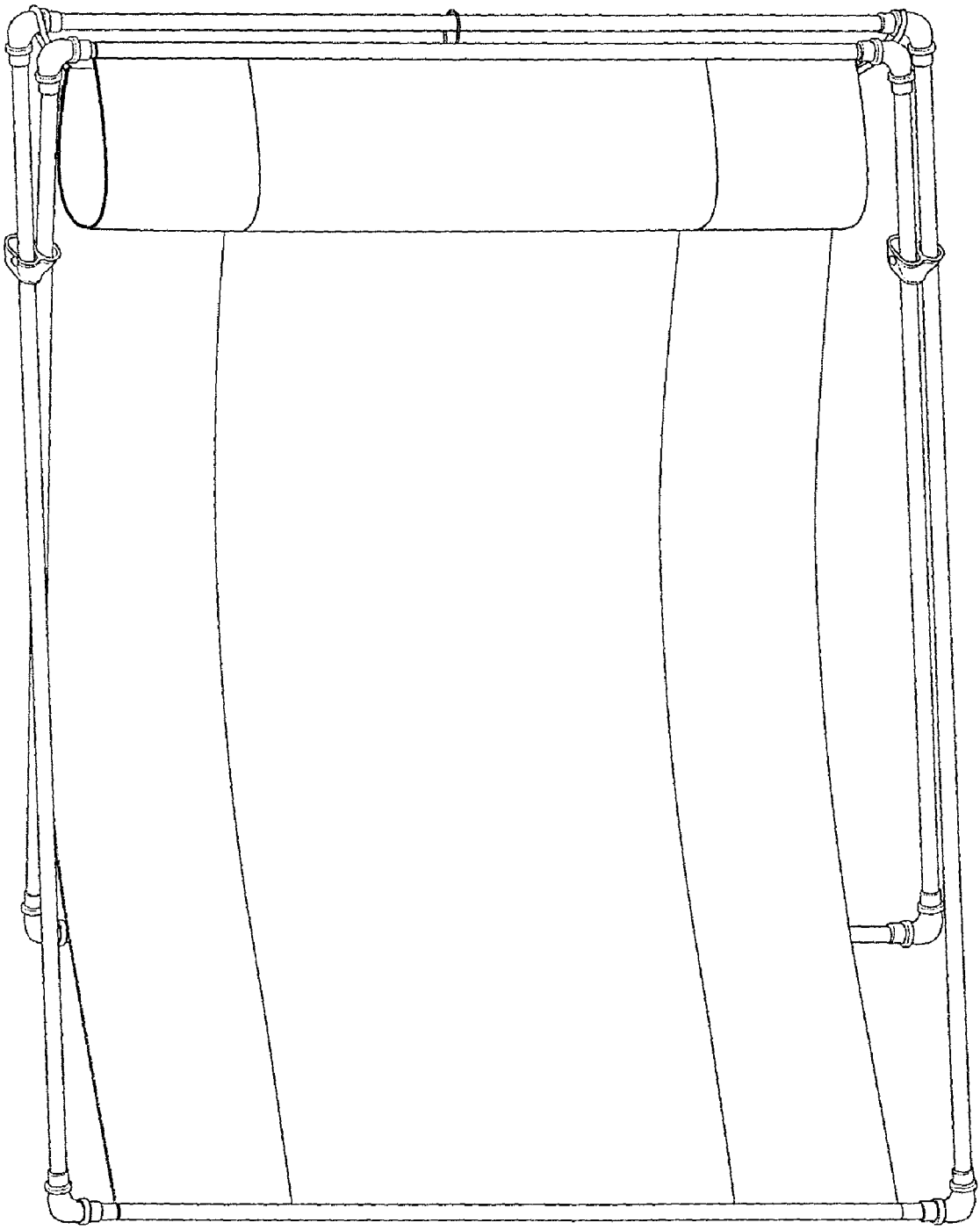
FIG. 8 is a perspective view from the front of the Practice Net of FIG. 1. while in a folded position for storage.
Figure 9:
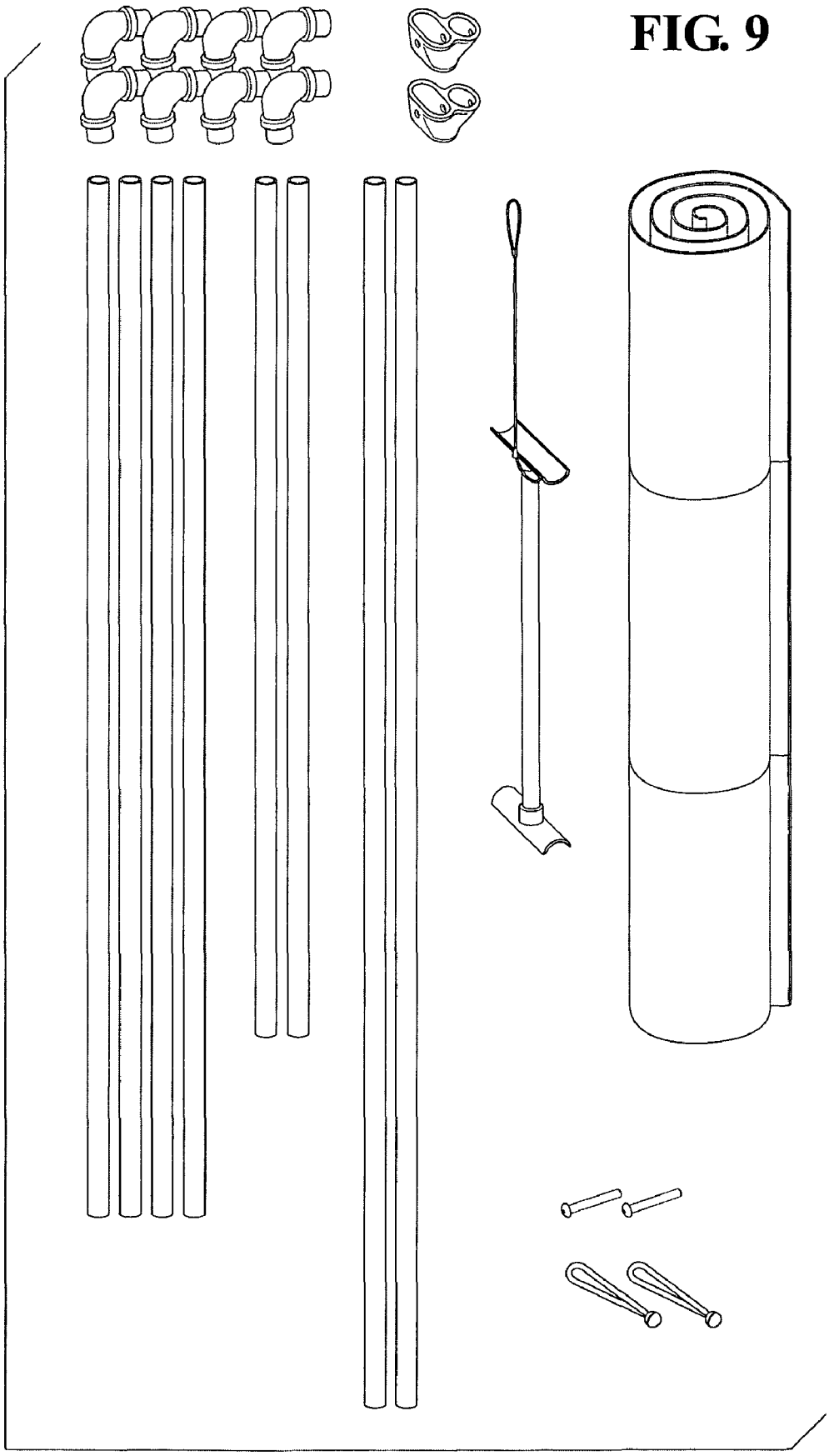
FIG. 9 is a perspective view of the components of the Practice Net of FIG. 1 in a disassembled state with the tarp rolled up.
Figure 10:
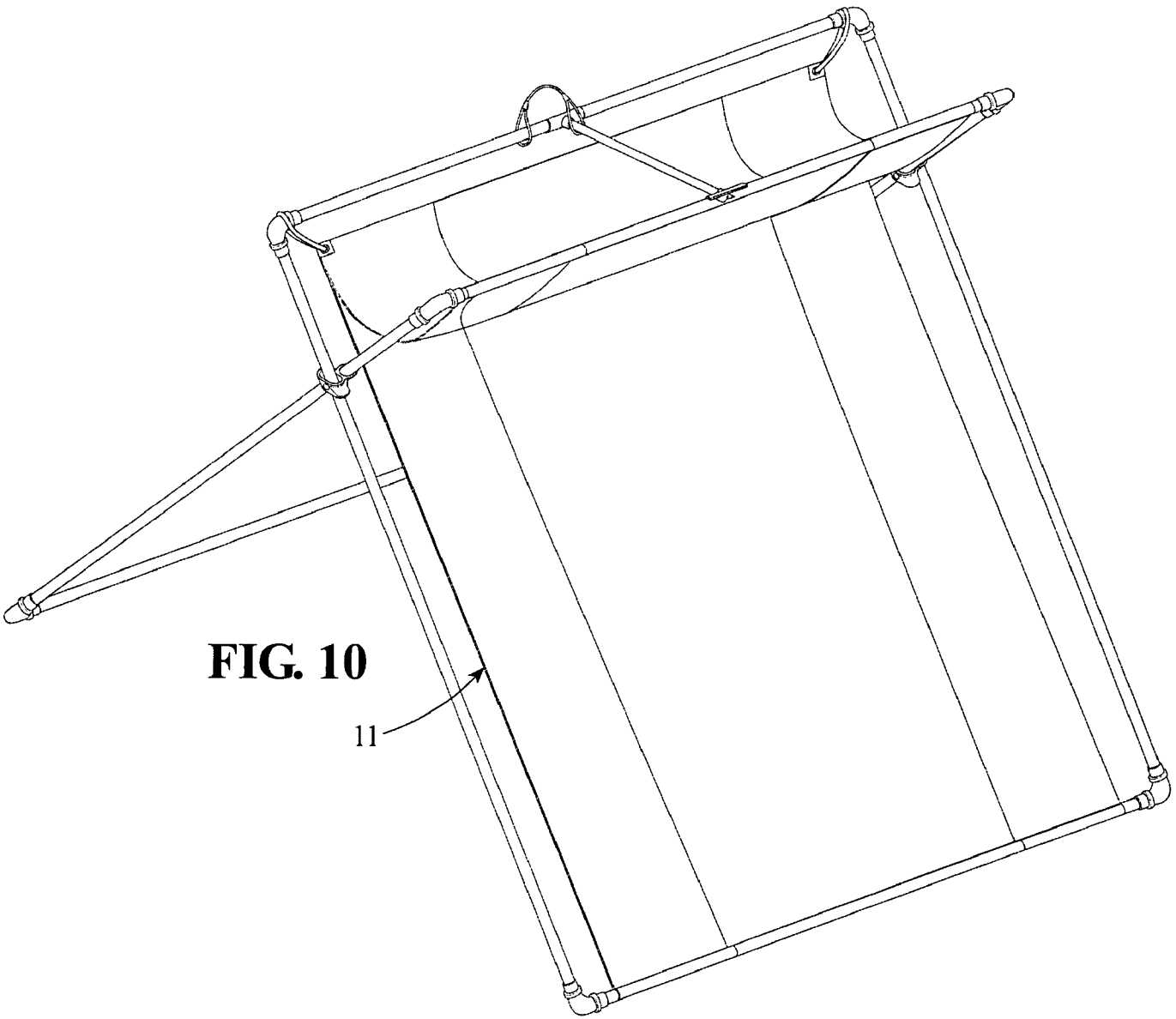
FIG. 10 is a top left perspective view of the front of the Practice Net for FIG. 1 also depicting the Power arm in a connected state.
Figure 11:
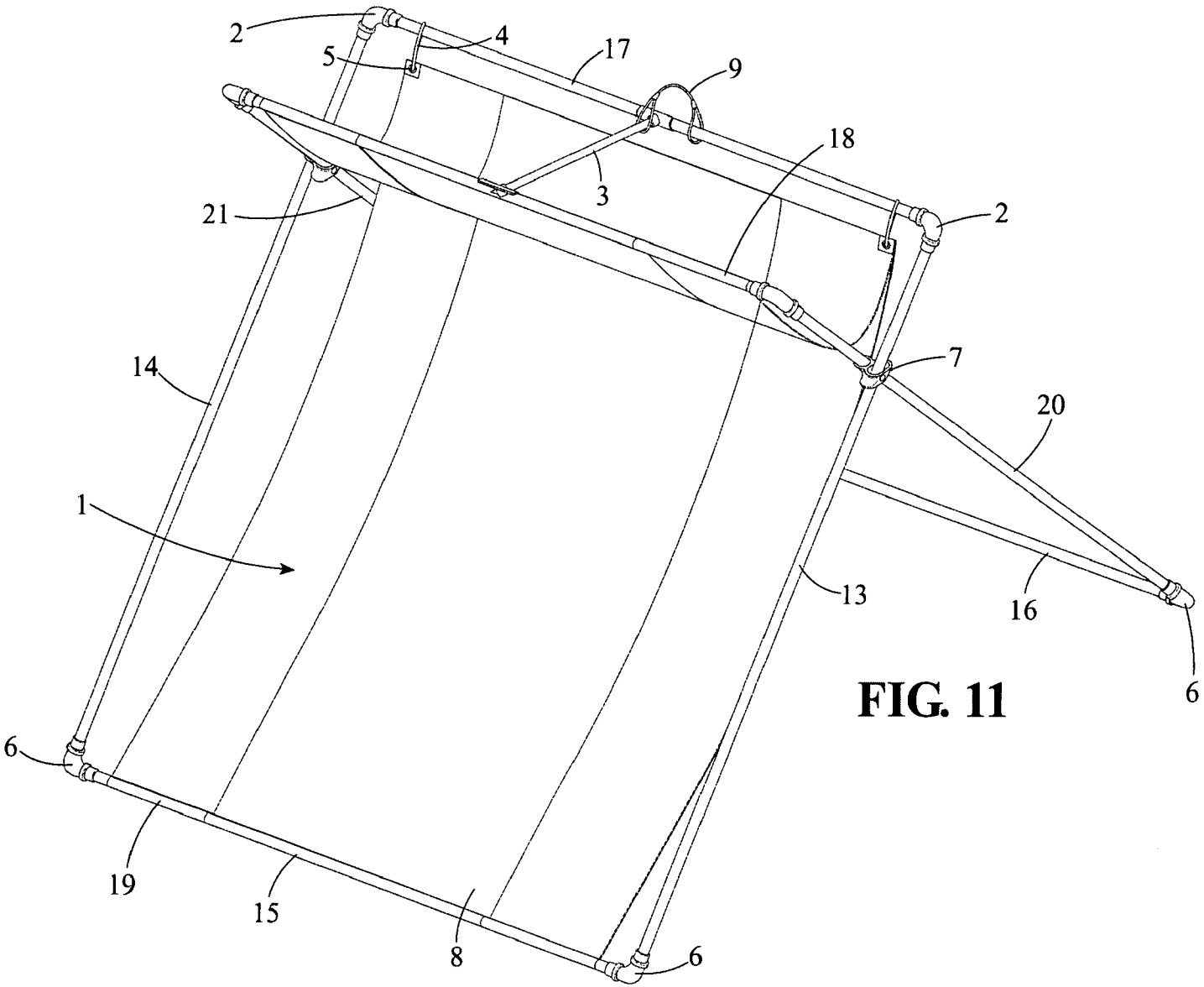
FIG. 11 is a top right perspective view of the front of the Practice Net for FIG. 1 also depicting the Power arm in a connected state.

The X frame portion of the frame of the preferred embodiment shall consist of a right front vertical Pole 13 and a left front vertical pole 14 which are connected to a right back vertical pole 20 and a left back vertical pole 21 by means of a swivel connecting means, to wit, a knuckle 7 held in place with an axis pin 22. The knuckle 7 is specially designed to limit the extension of the angle formed by the "X" in the frame and thus provide self support. FIGS. 6 and 7 show a close up of the knuckle 7 holding front and back poles together and one means in which an axis pin can be employed in accomplishing this task. The knuckle 7 is the preferred means with which the front and back squares are connected.

The preferred embodiment of the Fabric Tarp 1 is an upwardly inclined mesh net which is attached at one end to the Front Bottom Horizontal Pole 15 and at its body to the Front Top Horizontal Pole 18. The preferred embodiment of the upwardly inclined Fabric Tarp 1 has a vertical stripe down its middle 8. This stripe 8 assists the user of the invention with targeting. The upwardly inclined Fabric Tarp 1 is connected to the frame by a connecting means at the top and the bottom of the frame. In the preferred embodiment of the invention, the upwardly inclined Fabric Tarp 1 is connected to the front top Horizontal pole 18 using several tension loops 4 as a connecting means. Grommets 5, are utilized to ensure that the holes in which the tension loops 4 connect with the net 1 are reinforced. The preferred embodiment of the tension loop 4 is a tension loop made of rubber and nylon. A tension loop retainer ring 24 is utilized to hold the tension loop 4 inside the grommet when dismantled for folding, collapsing or storing. The preferred embodiment of the tension loop retainer ring 24 is nylon.

In the preferred embodiment of the invention, the bottom of the upwardly inclined Fabric Tarp 1 is connected to the front bottom pole 15 using a bottom loop 19. This bottom loop 19 is covered with a belting material. The preferred embodiment of the bottom loop is a bottom loop 19 covered with a belting material which is made of nylon. While nylon tension loops such as those nylon tension loops used to connect the Fabric Tarp 1 to the front top Horizontal pole 18 could be utilized to connect the bottom of the Fabric Tarp 1 to the front bottom Horizontal pole 15, the preferred embodiment of the invention uses a bottom loop with the nylon belting material 19 to enhance the utility of the Fabric Tarp 1 and to ensure that the Fabric Tarp 1 is not easily worn out by the contact with the ground that it may be subjected to.

The energy absorbing pocket 10 can, as set forth herein, be connected to the frame of a net separately as a separate item working in conjunction with an upwardly inclined Fabric Tarp 1 such as that set forth herein or can be interconnected with such a Fabric Tarp. The preferred embodiment of this invention has an energy absorbing pocket 10 interconnected with the X frame. In the preferred embodiment, the Fabric Tarp is a mesh net measured so that the grommets 5 are placed in a position on the net where the net will have the tension necessary to allow a soccer ball to travel up the length of the frame. The remaining end of the Fabric Tarp is connected to the back top Horizontal pole 17 using a connecting means. The preferred connecting means is a loop around said back top pole 17 to form a top loop. The Fabric Tarp/mesh net shall have slack enough to create the effect necessary for the energy absorbing pocket 10 which is formed in this manner to accomplish the task of absorbing a soccer ball's energy and sending it back down the portion of the Fabric Tarp 1 which is upwardly inclined in a controlled manner. If the energy absorbing pocket 10 is too big due to too much net being used, it can lead to the ball being held in the pocket due to portions of the Fabric Tarp falling over either the back top Horizontal pole 17 or the front top Horizontal pole 18 and getting stuck. In the preferred embodiment, the energy absorbing pocket 10 formed is large enough to ensure that a soccer ball is returned in a control manner but small enough to prevent the ball from getting stuck in the pocket 10 and not being returned. The energy absorbing pocket 10 is formed at the top of the net by keeping the bottom upwardly inclined portion of the Fabric Tarp under tension. The pocket portion of the Fabric Tarp is slack and forms a drape. The pocket in the preferred embodiment will catch a ball and sends the ball back down the upwardly inclined portion of the Fabric Tarp 1 using the pull of gravity to send the ball back the kicker. The Fabric Tarp 1 in the preferred embodiment is inclined in such a way that the front vertical poles (13 and 14) form acute angles with the ground, leading to the upward incline of the Fabric Tarp 1. This is further accomplished by making the front and back members different sizes. In the preferred embodiment of the invention, the back member is smaller than the front member.

The tension in the upwardly inclined portion of the Fabric Tarp 1 and the pocket 10 are maintained by a nylon tension cord 4 that forms a loop with a ball on the end. The loop is fastened around the Back top Horizontal pole 17 and the ball is secured at a grommet 5 located approximately 80% up the net/ramp 1 from the bottom. The tension loop retainer ring 24 is slid over the loop end of the tension loop 4 after the loop is placed through the grommet 5 thus keeping it in place.

The power arm 3 is part of the invention that locks the front top Horizontal pole 18 and the back top Horizontal pole 17 together to resist the force of a soccer ball and prevent the invention from folding or tipping. The power arm 3 also serves to transmit the force of the energy absorbing pocket 10 more efficiently through the entire frame. The power arm 3 is held to the front top Horizontal pole 18 with a restraining cable 9 so that the power arm 3 will not be lost or misplaced and remains with the invention at all times.

Figure 2:
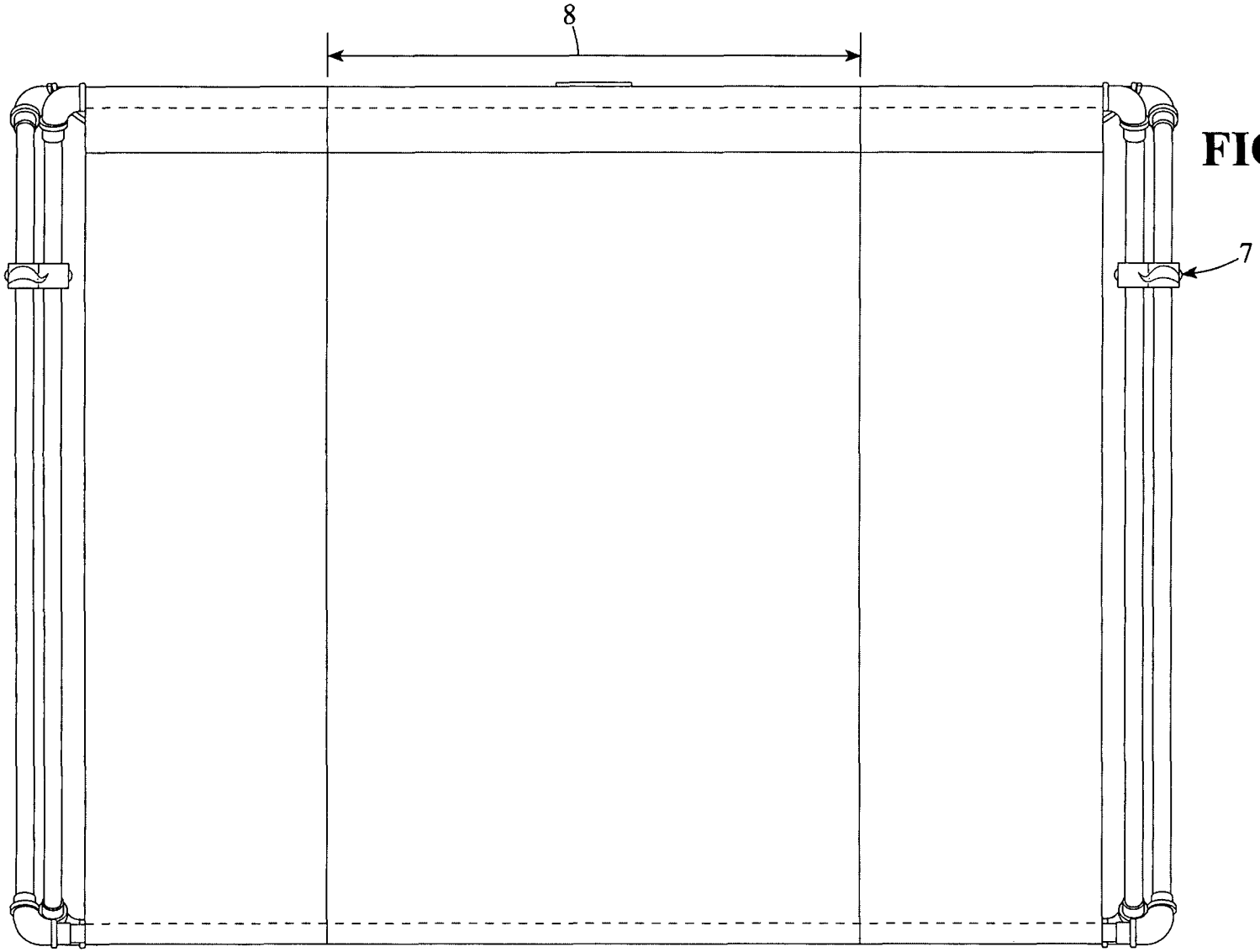
FIG. 2 is a perspective view from the back of the Practice Net of FIG. 1 while in a folded position for storage.
Figure 3:
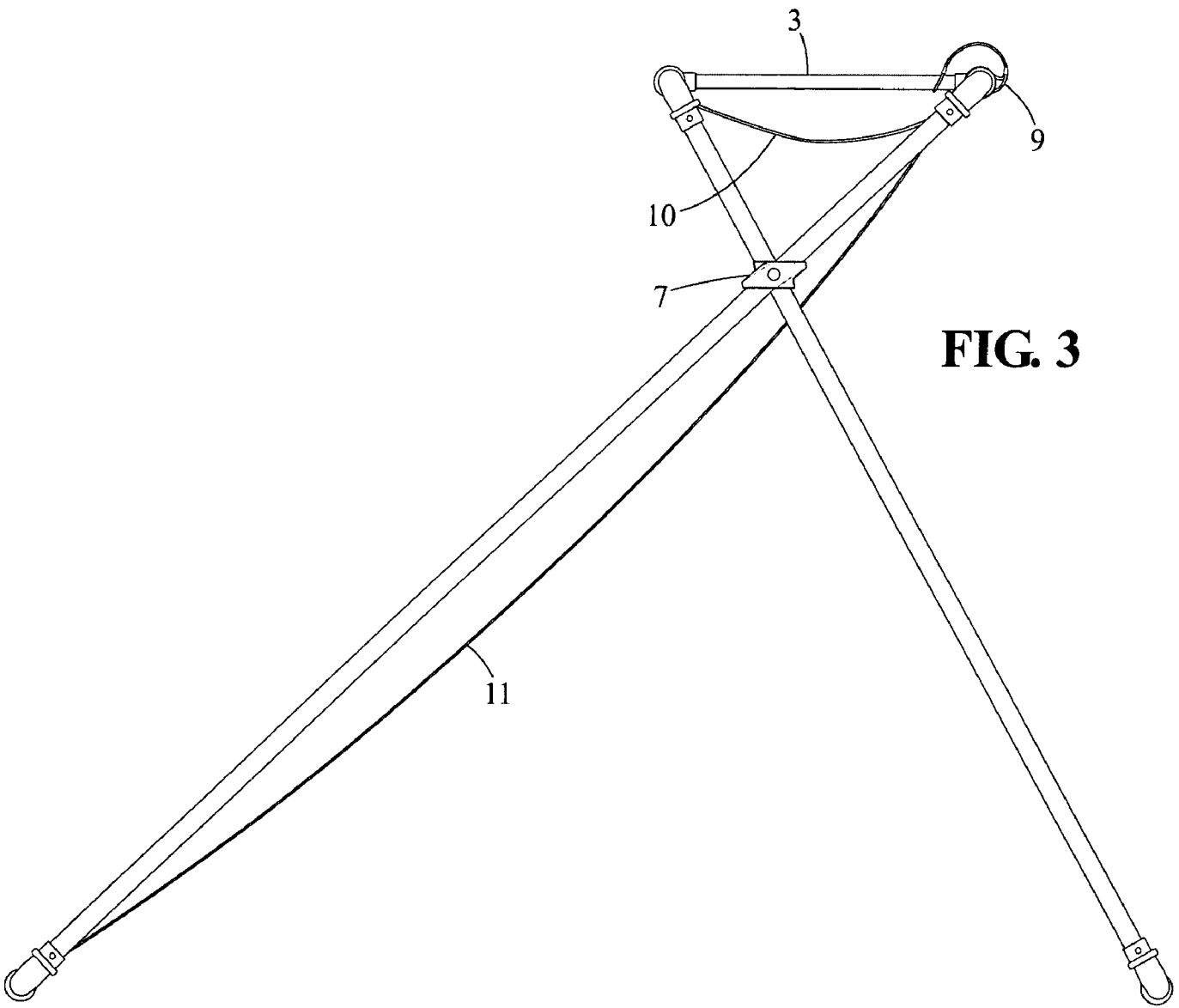
FIG. 3 is a perspective view from the right side of the Practice Net of FIG. 1.
Figure 4:
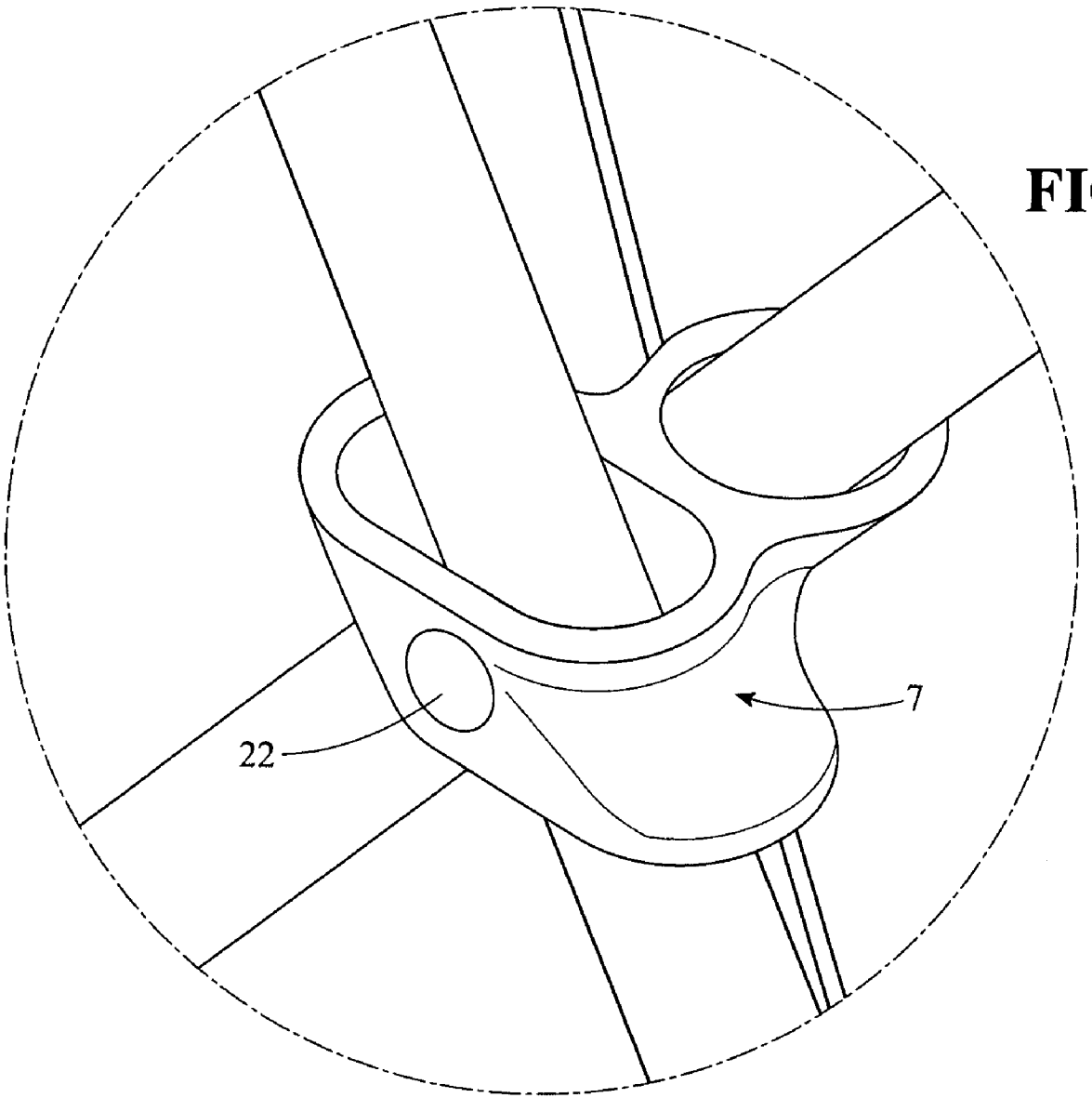
FIG. 4 is a close up view of the Knuckle of the Practice Net of FIG. 1.
Figure 5:
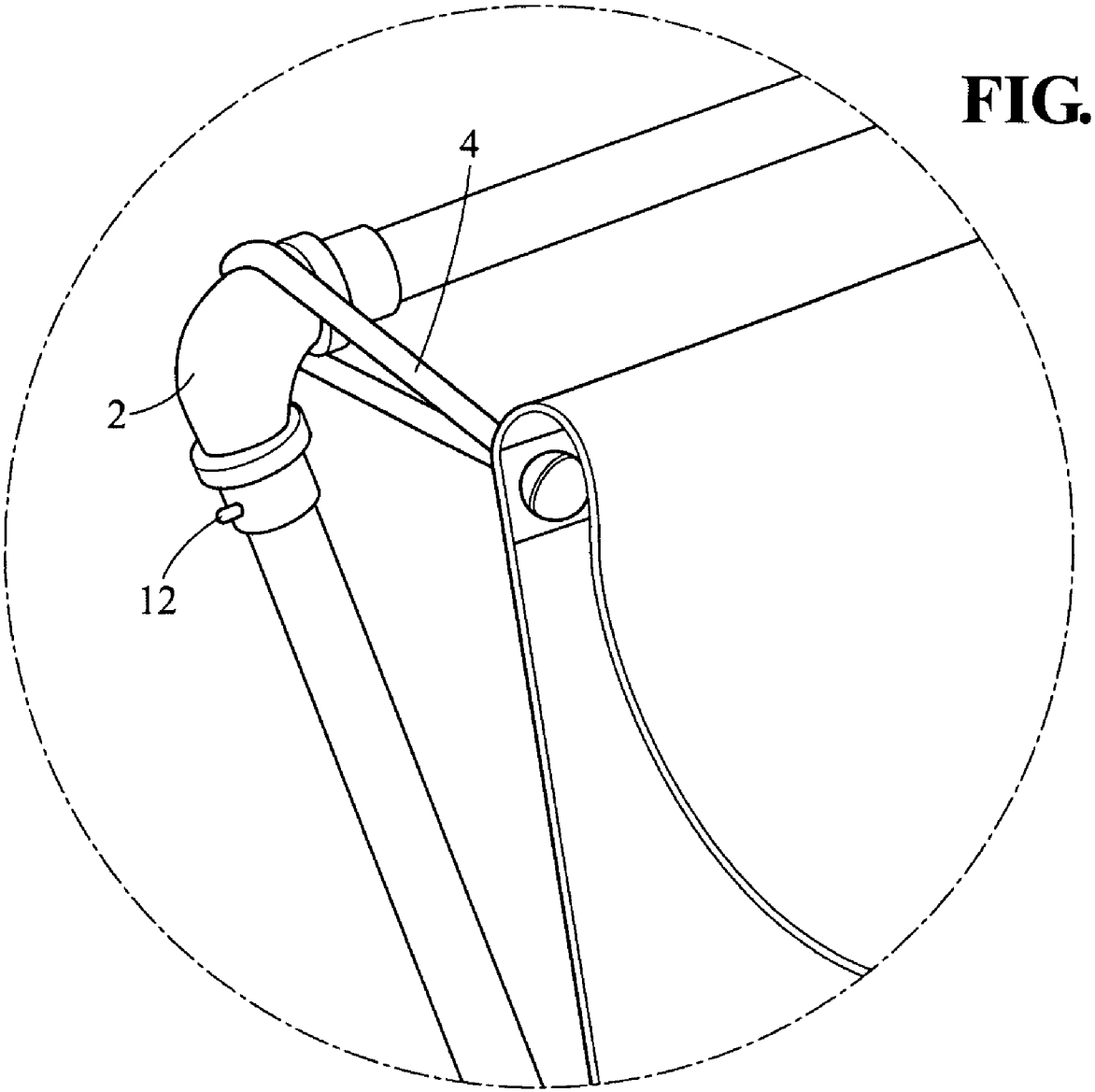
FIG. 5 is a close up view of the left top of the top back horizontal pole depicting the fabric tarp connecting means.

The preferred embodiment of the invention is a portable soccer practice net that folds in two dimensions and also is collapsible for easy transport and storage. The net folds flat for easy portability and can lie flat against a wall, as shown in FIG. 2. It also collapses by unlocking the side X assemblies from each corner and rolling up net so that the entire assembly fits into a nylon bag that is 68"×12". The unit is designed for indoor and outdoor use. The rubber corner feet of the preferred embodiment can grip any surface and will not mar finishes. The preferred embodiment of the invention is ideal for moving inside the garage for example during inclement weather.

What is claimed is:

1. An apparatus for facilitating the return of a ball driven by a user comprising:

a frame having a first horizontal support member and a second horizontal support member spaced from the first horizontal support member and located rearwardly thereto to create a first space therebetween, the frame having ground contacting portions to allow the frame to stand upon the ground; and a ball return member coupled to the frame, the ball return member including a first ball return surface defined by a first section of material that is inclined relative to the ground in a direction toward the second horizontal support member, the first ball return surface including a bottom portion that is coupled to one ground contacting portion of the frame and an opposite top portion that is coupled to the second horizontal support member, the ball return member including a second ball return surface that is defined by a second section of material that is coupled at a first end to the second horizontal support member and extends in a forward direction such that a second end thereof is coupled to the first horizontal support member to define a pocket in the first space between the first and second horizontal support members, the pocket being configured and positioned relative to the inclined first ball return surface such that the pocket catches a driven ball that travels along the inclined first ball return surface to a top portion thereof and absorbs the energy of the driven ball before the ball travels by gravity back down the inclined first ball return surface back to the user, wherein the first ball return surface and the second ball return surface are coupled to the second horizontal support member such that they are spaced and suspended from the second horizontal support member.

2. The apparatus of claim 1, wherein the first and second sections of material are part of the same single piece of cut fabric.

3. The apparatus of claim 1, wherein the frame is X-shaped.

4. The apparatus of claim 1, wherein the piece of material comprises a fabric material.

5. The apparatus of claim 1, wherein the pocket is suspended between the first top horizontal support member and the second top horizontal support member with sufficient slack to permit the pocket to receive the driven ball and absorb the ball's energy before the driven ball.

6. The apparatus of claim 1, wherein the inclined ball return surface is under tension.

7. The apparatus of claim 1, further including a locking arm that is coupled to the second top horizontal support member and selectively engages the first top horizontal support member to lock the first top horizontal support member and the second top horizontal support member together.

8. The apparatus of claim 1, wherein the first and second sections of material are part of the same single piece of cut fabric with the second section being draped over the first section so as to have a curved shape.

9. The apparatus of claim 1, wherein the ball return member is coupled to the second horizontal member with tension members that suspend and space the ball return member from the second horizontal member and permit movement of the ball return member relative to the second horizontal member.

10. The apparatus of claim 9, wherein the tension member is attached to the first and second sections through a common opening.

11. The apparatus of claim 1, wherein the second ball return surface has a concave shape as viewed from the first and second horizontal support members.

12. An apparatus for facilitating the return of a ball driven by a user comprising:

a foldable frame having a first top horizontal support member and a second top horizontal support member spaced from the first top horizontal support member and located rearwardly thereto to create a first space therebetween, the frame having ground contacting portions, including a bottom front horizontal member, to allow the frame to stand upon the ground, wherein a plane that passes through the bottom front horizontal member and the second top horizontal support member is inclined relative to the ground in a direction toward the second top horizontal support member; and a ball return member coupled to the frame, the ball return member including a piece of material that has a first end that is coupled to the bottom front horizontal member, the piece of material being folded over itself along a fold line with the piece of material being coupled to the second top horizontal member at or proximate the fold line to define an inclined ball return surface, an opposite second end of the piece of material being coupled to the first top horizontal member, thereby resulting in the piece of material being at least partially draped over itself to define a curved section that is located between the first and second top horizontal support members and create a pocket in the first space, the curved section having a bottom that is below both of the first and second horizontal support members, the pocket being configured and positioned relative to the inclined ball return surface such that the pocket catches a driven ball that travels along the inclined ball return surface and absorbs the energy of the driven ball before the ball travels by gravity back down the inclined ball return surface to the user and wherein the ball return member is coupled to the frame such that the top portion of the inclined first ball return surface is spaced and suspended from the frame by a plurality of tension members.

13. An apparatus for facilitating the return of a ball driven by a user comprising:

a ball return member coupled to a frame or net, the ball return member including a first ball return surface defined by a first section of material that is inclined relative to the ground and includes a bottom portion that is fixed relative to the frame and an opposite top portion that is coupled to frame, the ball return member including a second ball return surface that is defined by a second curved section of material that is coupled the frame and extends in a forward direction such that a second end extends over the first section of material to define a pocket that is in communication with a top portion of the inclined first ball return surface, the second curved section having a bottom that is below a top portion of the frame, the pocket being configured and positioned relative to the inclined first ball return surface such that the pocket catches a driven ball that travels along the inclined first ball return surface to the top portion thereof and absorbs the energy of the driven ball before the ball travels by gravity back down the inclined first ball return surface back to the user, wherein the ball return member is coupled to the frame such that the top portion of the inclined first ball return surface is spaced and suspended from the frame by a plurality of tension members.

14. An apparatus for facilitating the return of a ball driven by a user comprising:

a frame having top front and rear horizontal support members and ground contacting support members; and a ball return member coupled to the frame, the ball return member including a continuous length of material that is folded about a fold line that defines a top edge of an inclined first section of the ball return member that is attached to the top rear horizontal support member and to the ground support member, wherein a folded section of the ball return member comprises a curved second section that extends forward over the first section and is coupled to a top front horizontal support member to define a pocket that is in communication with a top portion of the inclined first section, the pocket being configured and positioned relative to the inclined first ball return surface such that the pocket catches a driven ball that travels along the inclined first section to the top portion thereof and absorbs the energy of the driven ball before the ball travels by gravity back down the inclined first ball return surface back to the user, wherein the ball return member is coupled to the frame such that the top edge of the inclined first section is spaced and suspended from the frame by a plurality of tension members, the tension members extending through the inclined first section below the fold line such that the folded section covers front ends of the tension members, the upper edge being located below the top front and rear horizontal support members and wherein the first ball return surface and the second ball return surface are coupled to the second horizontal support member such that they are spaced and suspended from the second horizontal support member.

15. A method for returning a driven ball to a player in a controlled manner utilizing the device of claim 1 comprising the steps of:

providing a ball return apparatus including:

a frame having a first top horizontal support member and a second top horizontal support member spaced from the first top horizontal support member and located rearwardly thereto, the frame configured to rest on the ground in an upright manner; and a ball return member coupled to the frame, the ball return member including a piece of material that is coupled to and supported by the frame such that a first section of the piece of material is under tension and coupled to the second top horizontal support member and inclined relative to the ground, the ball return member further including an energy absorbing pocket that is located along a top of the first section and is formed of material that is draped over the first section of the material and is coupled to the first top horizontal member;

driving the ball toward the inclined first section of material to cause the ball to strike and travel up along the inclined first section into the pocket;

absorbing energy of the driven ball by catching the ball within the pocket;

delivering the ball by gravity from the pocket to the inclined first section where it travels therealong towards the ground; and receiving the ball back from the apparatus to allow the ball to be driven again towards the inclined first section.

* * * * *